US008485620B2

(12) United States Patent
Kitabatake et al.

(10) Patent No.: US 8,485,620 B2
(45) Date of Patent: Jul. 16, 2013

(54) INKJET PRINTER AND BUBBLE REDUCING METHOD FOR INKJET PRINTER

(75) Inventors: Nobuhiro Kitabatake, Kawasaki (JP); Yoshinori Nakagawa, Kawasaki (JP); Yuji Hamasaki, Kawasaki (JP); Atsushi Takahashi, Kawasaki (JP); Kei Yoshizawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 98 days.

(21) Appl. No.: 13/208,878

(22) Filed: Aug. 12, 2011

(65) Prior Publication Data

US 2012/0050358 A1 Mar. 1, 2012

(30) Foreign Application Priority Data

Aug. 31, 2010 (JP) ..... 2010-194745

(51) Int. Cl.
*B41J 29/38* (2006.01)

(52) U.S. Cl.
USPC ..... 347/6; 347/85; 347/92

(58) Field of Classification Search
USPC ..... 347/5, 6, 7, 22, 23, 25, 84–87, 92–94
See application file for complete search history.

(56) References Cited

U.S. PATENT DOCUMENTS 7,150,519 B2 * 12/2006 Kono et al. ..... 347/85
2012/0050421 A1 3/2012 Hamasaki et al.
2012/0050426 A1 3/2012 Nakagawa et al.

FOREIGN PATENT DOCUMENTS

JP 2007-098959 A 4/2007

* cited by examiner

*Primary Examiner* — Juanita D Jackson
(74) *Attorney, Agent, or Firm* — Fitzpatrick, Cella, Harper & Scinto

(57) ABSTRACT

The inkjet printer can discharge a bubble in an ink flow path while suppressing ink consumption. Ink in an ink tank is supplied to a printing head through a flow path and filter. Bubbles in the flow path and printing head are discharged by applying a negative pressure to an ejection port of the printing head. At this time, after a first negative pressure has been applied to the ejection port with an on/off valve provided between the ink tank and the filter being closed, the on/off valve is opened to discharge the ink from the ejection port. Further, after that, a second negative pressure at a level that makes it difficult for a bubble to pass through the filter is applied to the ejection port to discharge a bubble present at a location, which is closer to the printing head than the filter is to printing head, from the ejection port together with the ink.

11 Claims, 8 Drawing Sheets

INKJET PRINTER AND BUBBLE REDUCING METHOD FOR INKJET PRINTER

BACKGROUND OF THE INVENTION

1. Field of the Invention

The present invention relates to an inkjet printer and a bubble reducing method for an ink jet printer that perform printing with use of a printing head in which ejection ports ejecting ink are arrayed.

2. Description of the Related Art

There is known an inkjet printer that supplies ink from an ink tank containing the ink to a printing head through an ink supply path, and ejects the ink from a nozzle arranged in the printing head to perform printing. In the inkjet printer, a bubble accumulates in the ink supply path or printing head, which may cause the occurrence of improper ejection in the printing head.

As one of methods for removing the bubble, a cleaning process that seals a formation surface of an ejection port of the nozzle of the printing head by a capping unit, and sucks and discharges the bubble mixed in the ink, together with the ink, from the ejection port by negative pressure from a suction pump is performed.

In general, in the middle of the ink flow path to the printing head, in order to prevent a foreign substance mixed in the ink supplied from the ink tank from approaching, a filter member is arranged. A bubble in the ink flow path on an upstream side (ink tank side) of the filter member can be discharged by generating fast flow of the ink at the time of the cleaning process. As the cleaning process that generates the fast ink flow as described, a cleaning process called choke cleaning is proposed.

In the choke cleaning, first performed is an operation that, at the time of starting to suck ink through a capping unit, closes an on/off valve (hereinafter referred to as a choke valve) present between an ink tank and a filter to bring an inside of the capping unit to a predetermined negative pressure, and then opens the choke valve. According to this, a flow speed of the ink in the printing head can be instantaneously increased, and thereby the bubble on the upstream side of the filter member can be passed through the filter member and discharged outside.

However, in the case of performing the above choke suction, there is a problem that the negative pressure accumulated on the capping unit side is also instantaneously reduced by the ink flowing in, which may stop short of sufficiently discharging the bubble. In this case, the bubble remains in the ink flow path in the printing head, which may cause improper ejection.

As the choke cleaning for improving the above problem, Japanese Patent Laid-Open No. 2007-98959 proposes a sequence that, at the time of performing the choke cleaning, depressurizes a flow path, and even after opening the choke valve, keeps performing the suction without stopping the suction pump. This is intended to discharge the bubble from the printing head together with the continuous ink flow.

However, in the choke cleaning having the sequence disclosed in Japanese Patent Laid-Open No. 2007-98959, in the process from opening the choke valve to stopping the suction pump, as long as the bubble is present on the upstream side of the filter, the bubble may pass through the filter to flow into the printing head. That is, as long as the suction operation is not continued until the bubble on the upstream side of the filter is completely eliminated, the bubble may be mixed into the printing head to cause the improper ejection. For this reason, in the case of attempting to completely eliminate the bubble on the upstream side of the filter, there is a problem that a large amount of ink should be consumed, which increases running cost.

SUMMARY OF THE INVENTION

The present invention is intended to provide an inkjet printer and inkjet printing method that can, while suppressing ink consumption, discharge a bubble in an ink flow path, which causes improper ejection of a printing head.

In order to solve the above problem, the present invention has the following configuration.

That is, a first aspect of the present invention is an inkjet printer that supplies ink in an ink tank to a printing head through a flow path and a filter provided in the flow path, and ejects the ink from an ejection port of the printing head to perform printing, the inkjet printer being provided with: an on/off valve that is provided more closely on a side of the ink tank than the filter in the flow path; a negative pressure generating unit for generating a negative pressure to be applied to the ejection port; and a control unit that controls operation of the on/off valve and operation of the negative pressure generating unit, wherein: the negative pressure generating unit can apply, to the ejection port, a first negative pressure that enables a bubble present in the flow path more closely on the ink tank side than the filter to pass through the filter, and a second negative pressure that has a smaller absolute value than the first negative pressure and prevents the bubble from passing through the filter; and the control unit controls the negative pressure generating unit to apply the first negative pressure to the ejection port with closing the on/off valve, and then, after opening the on/off valve, controls the negative pressure generating unit to apply the second negative pressure to the ejection port.

A second aspect of the present invention is an inkjet printer that can supply ink in an ink tank to a printing head through a flow path and a filter provided in the flow path, and eject the ink from an ejection port of the printing head to perform printing, and also can externally apply a negative pressure to the ejection port of the printing head to thereby discharge a bubble present at and inside the printing head from the ejection port of the printing head together with the ink, the inkjet printer being provided with: an on/off valve that is provided in the flow path; a negative pressure generating unit that generates a negative pressure to be applied to the ejection port of the printing head; and a control unit that controls the negative pressure generating unit, wherein the control unit performs: first cleaning operation that controls the negative pressure generating unit to apply a first negative pressure to the ejection port with closing the on/off valve, and then opens the on/off valve; and second cleaning operation that controls the negative pressure generating unit to apply to the ejection port a second negative pressure that prevents a bubble from passing through the filter.

A third aspect of the present invention is a bubble reducing method for an inkjet printer that supplies ink in an ink tank to a printing head through a flow path and a filter provided in the flow path, and ejects the ink from an ejection port of the printing head to perform printing, the bubble reducing method being provided with the steps of: with closing an on/off valve provided between the ink tank and the filter, applying a first negative pressure that enables a bubble present in the flow path more closely on a side of the ink tank than the filter to pass through the filter; and after opening the on/off valve, applying, to the ejection port, a second negative pressure that has a smaller absolute value than the first negative pressure and prevents the bubble from passing through the filter.

According to the present invention, a bubble in an ink flow path, which causes improper ejection of a printing head, can be discharged while suppressing ink consumption, and ink in the ink flow path can be discharged while suppressing running cost.

Further features of the present invention will become apparent from the following description of exemplary embodiments (with reference to the attached drawings).

DESCRIPTION OF THE EMBODIMENTS

Embodiments of the present invention will hereinafter be described on the basis of the drawings.

First Embodiment

First, on the basis of FIGS. 1 to 7, a first embodiment of the present invention is described.

Figure 1:
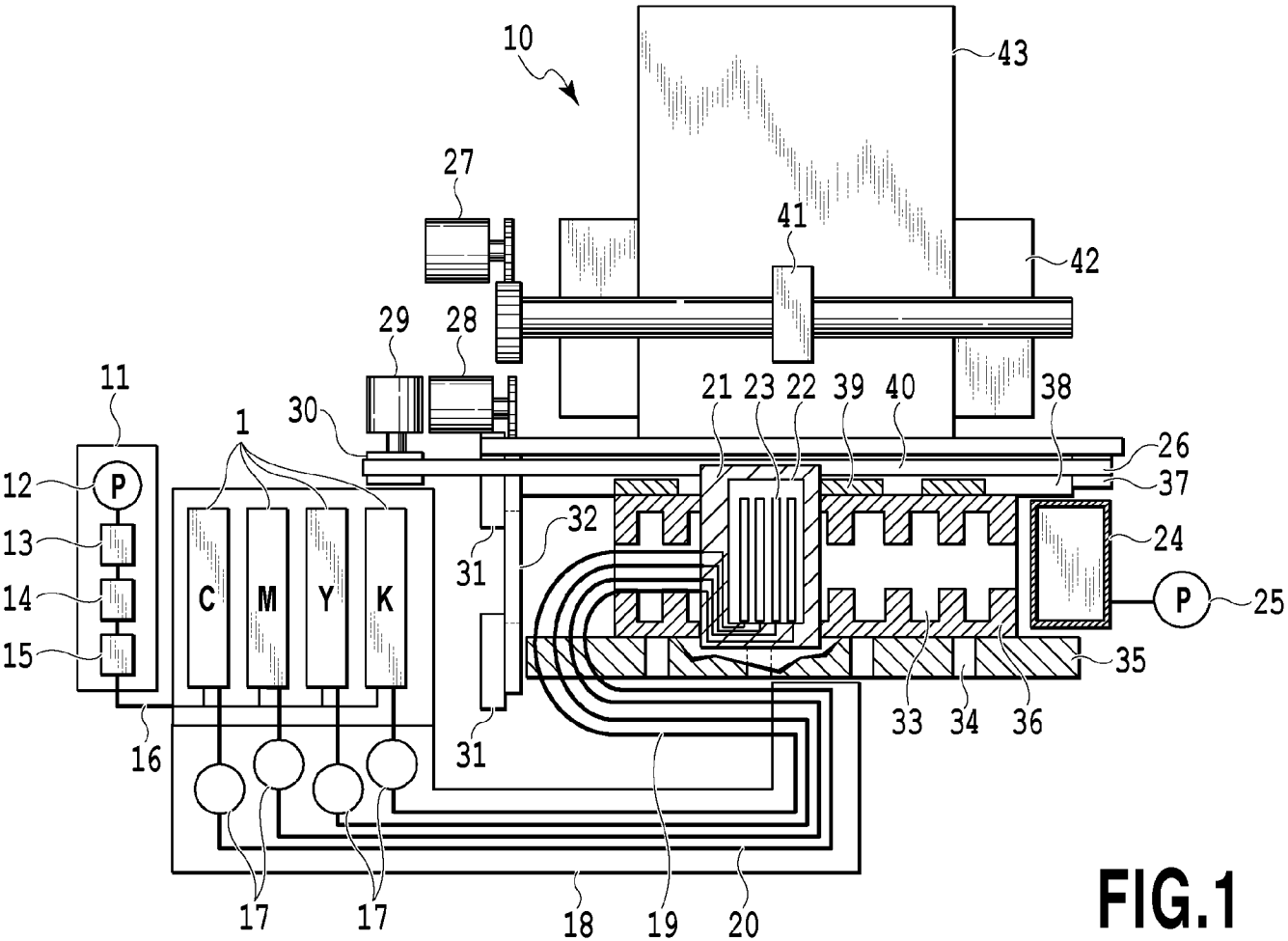
FIG. 1 is a plain view illustrating a schematic configuration of an inkjet printer in an embodiment.

As illustrated in FIG. 1, a carriage 21 is mounted with a printing head 22 that is provided with a plurality of nozzles 49 for ejecting inks as droplets. Also, the carriage 21 is mounted with sub-tanks 23 that respectively temporarily retain the inks to be supplied to the printing head 22. Each of the nozzles of the printing head 22 is provided with a connector that transmits/receives a signal for driving an ejection energy generating element for ejecting a corresponding one of the inks from the nozzle, or the like. The connector is electrically connected to an unillustrated ASIC. Note that as the ejection energy generating element, an electrothermal transducing element such as a heater or an electromechanical transducing element such as a piezo can be used.

The carriage 21 is supported by a guide shaft 26, and can reciprocate along the guide shaft 26. The reciprocation of the carriage 21 is performed through a driving mechanism including a main scanning motor (CR motor) 29, motor pulley 30, driven pulley 37, timing belt 40 wound between these pulleys, and the like.

In a stage before the start of printing is instructed, printing media 43 are placed on an automatic sheet feeder 42. When the start of printing is instructed, a sheet feeding motor 27 is driven by an after-mentioned control system, and corresponding driving force is transferred to a pickup roller 41 through a gear. On the basis of this, the pickup roller 41 rotates, and the printing media 42 placed on the automatic sheet feeder 42 are supplied to a printer main body one by one.

The printing medium 43 fed from the automatic sheet feeder 42 is conveyed by rotation force of a conveying roller 38. The conveying roller 38 is rotated by rotation force of a conveying motor 28, which is transferred thereto through a gear. Also, the conveying roller 38 and a driven roller 35 are connected to each other by a belt member 32, and the conveying roller 38 rotates, whereby the driven roller 35 also rotates. A rotation amount and rotation speed of the conveying roller 38 are controlled by detecting, with an unillustrated rotation angle sensor, a slit of a code wheel 31 attached to the conveying roller 38, and feeding back information on the detection to a control driver of the conveying motor 28. On the basis of the rotation of the conveying roller 38, the printing medium 43 moves while being supported by a platen 36 in a flat state. When the printing medium 43 passes below an ejection port surface, the printing head 22 ejects the inks to the printing medium 43 according to a predetermined image signal. In addition, a pinch roller 39 and spur roller 34 are provided, respectively, as auxiliary rollers for increasing holding force for the printing medium 43.

On the other hand, the inks contained in ink tanks are supplied to the sub-tanks 23 held by the carriage 21 through an ink supply path including flow paths 20 formed on a flow path plate 18 and tubes 19 connected to the flow paths 20. The ink supply path is provided with on/off valves 17 (hereinafter referred to as choke valves) of which on/off can be controlled by the after-mentioned control system. The ink supply from the ink tanks 1 to the sub-tanks 23 is performed by supplying compressed air to the ink tanks 1 with an air compressor unit 11. The air compressor unit 11 includes a compression pump 12, pressure sensor 13, compression limiting valve 14, and air open valve 15. In the air compressor unit 11, when the compression pump 12 is driven to supply air into a compressed air supply path 16, the compressed air is supplied into the ink tanks 1. The compressed air causes the inks in the ink tanks 1 to be sent out to the flow paths 20, and supplied to the sub tanks 23. The compression limiting valve 14 is a valve that is, in order to prevent excessive pressure from being applied on the ink tanks 1, opened to air at a certain pressure or more. Also, the air open valve 15 is a solenoid valve that can switch between communicative connection and block between the compressed air supply path 16 and air, and by the switching of the solenoid valve, the compressed air inside the compressed air supply path 16 can be kept or released. Note that, in the inkjet printer 10 of the present embodiment, the ink tanks 1 and sub-tanks 23 for four colors of cyan (C), magenta (M), yellow (Y), and black (K) are provided, and have the same configurations regardless of color type.

Also, at a home position of the carriage 21, a maintenance unit that performs processing for maintaining ejection performance of the printing head is placed. The maintenance unit is provided with a capping member 24 that, in order to prevent thickening and drying of the inks inside the nozzles 49 provided in the printing head 22, at the time of non-printing, comes into abutting contact with the ejection port surface to block ejection ports from outer air. The capping member 24 is connected to a suction pump 25, and by bringing the capping member 24 into abutting contact with the ejection port surface and driving the suction pump 25, the inks inside the nozzles can be forcibly discharged outside through the capping member 24.

Figure 2A:
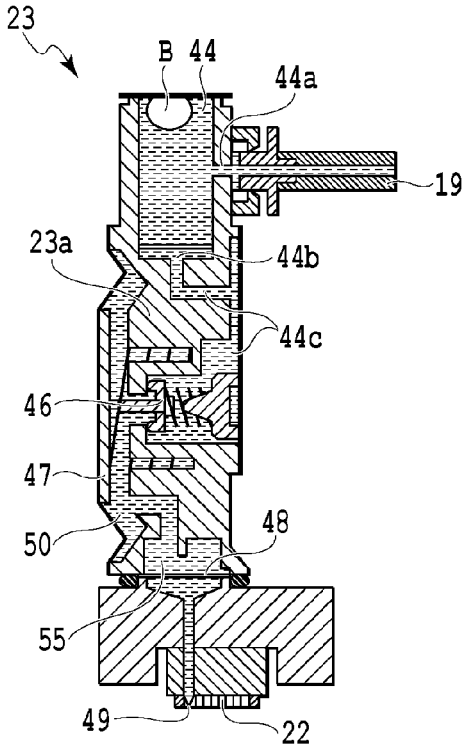
FIG. 2A is a vertical cross-sectional side view of a sub-tank in the embodiment.

FIG. 2A is a vertical cross-sectional view illustrating an internal structure of one of the sub-tanks 23. The sub-tank 23 is formed with a bubble buffer 44*a* that is intended to temporarily hold a bubble generated in a corresponding one of the tubes, and at the time of printing or on another occasion, prevent the bubble from flowing into a corresponding one of the nozzles 49. The bubble buffer 44 is formed with a flow-in port 44*a* and flow-out port 44*b*, in which the flow-in port 44*a* is communicatively connected to the tube 19, and the flow-out port 44*b* is communicatively connected to a negative pressure chamber 50 through a flow path 44*c*. The negative pressure chamber 50 is configured to have: a support body 23 that serves as a framework of the sub-tank; a side surface member 23*b* that is elastically deformably provided on one side surface of the support body 23*a*; and a pressure plate 47 that is fixed to the side surface member 23*b*. Further, the negative pressure chamber 50 is communicatively connected to the nozzle 49 of the printing head 22 through a filter 48. Also, the flow path 44*c* that makes a communicative connection between the negative pressure chamber 50 and the bubble buffer 44 is provided with a supply limiting valve 46 to be described below, which keeps a pressure inside the negative pressure chamber 50 at a negative pressure.

Figure 2B:
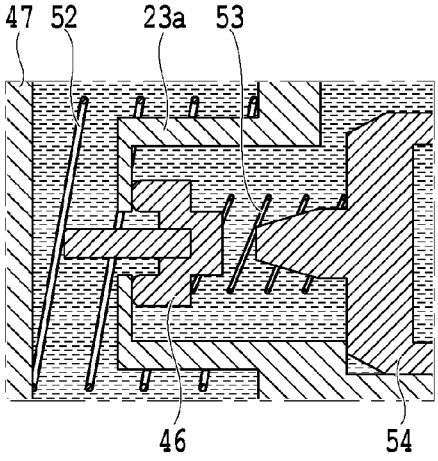
FIG. 2B is an enlarged view at the time of opening a supply limiting valve in the sub-tank illustrated in FIG. 2A.
Figure 2C:
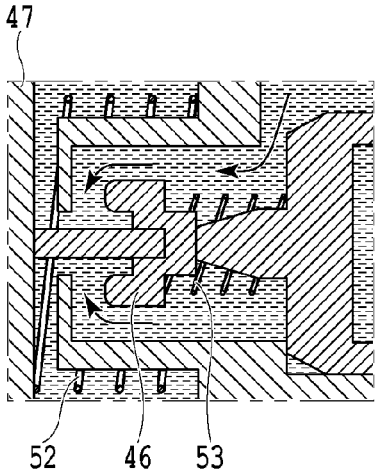
FIG. 2C illustrates a state at the time of closing the valve in the sub-tank illustrated in FIG. 2A.

FIGS. 2B and 2C are enlarged vertical cross-sectional side views illustrating a configuration of the supply limiting valve 43 and its periphery. As illustrated in the diagrams, the pressure plate 47 constituting the negative pressure chamber 50 is biased by a spring 52 in a direction away from the support body 23*a*, and in the case where the negative pressure of the negative pressure chamber 50 is kept constant, the negative pressure chamber 50 is adapted to keep a predetermined volume by biasing force of the spring 52. In the case where the negative pressure chamber is kept at the certain negative pressure, the supply limiting valve 46 is brought into close contact with the support body 23*a* by biasing force of a spring 53 provided between the supply limiting valve 46 and a valve holder 54 to bring a flow path into a blocked state, and therefore flow-in of the ink from the bubble buffer 44 side to the negative pressure chamber 50 side is blocked. Also, in FIG. 2C, in the case where the negative pressure of the negative pressure chamber 50 is increased, the pressure plate 47 moves to the support body 23*a* side against the biasing force of the spring 52, and therefore the volume of the negative pressure chamber 50 is reduced. Also, the supply limiting valve 46 is pressed by the moving pressure plate 47 to come into an open state where the supply limiting valve 46 is away from the support body 23*a*, and therefore the ink can flow in from the bubble buffer 44 side to the negative pressure chamber 50 side. Note that, in the present embodiment, immediately above the filter 48, a bubble buffer 55 that holds a bubble is also formed.

Figure 3:
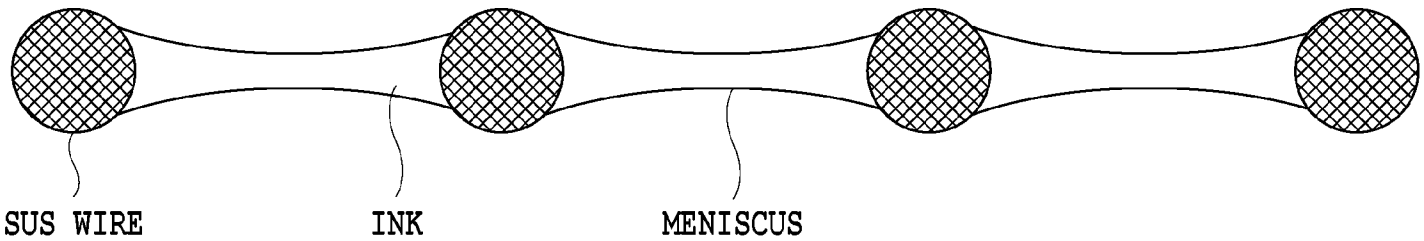
FIG. 3 is a cross-sectional view illustrating a state where menisci are formed in the filter in the embodiment.

The filter 48 has a mesh structure woven with SUS wires. FIG. 3 illustrates a cross section of the filter 48 for the case where the filter 48 is wet with the ink. In this case, in gaps between the SUS wires, menisci each of which is an interface between the ink and gas are formed, and in order for the gas to pass through, any of the menisci should be broken. A pressure difference necessary to break the meniscus is proportional to a surface tension of the ink, and inversely proportional to a circumferential length of the meniscus. In the case of the ink and filter 48 used in the present embodiment, the pressure difference necessary to break the meniscus, i.e., the pressure difference necessary for the gas to pass through the filter is 25 kPa. Also, even if the meniscus is once broken, it is immediately reproduced by capillary force, and therefore in order to make the gas continuously pass through, the above pressure difference should be kept.

Figure 4:
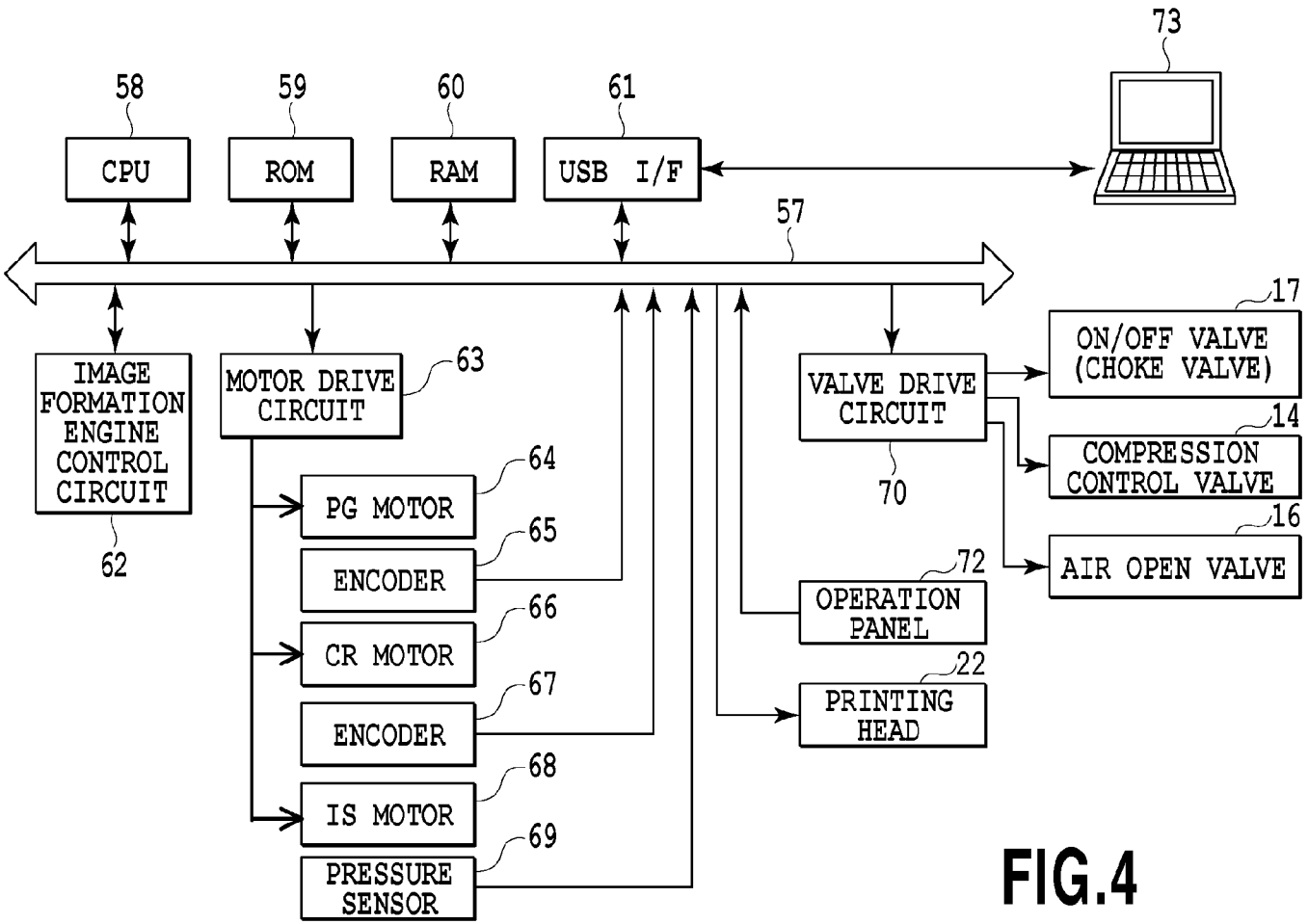
FIG. 4 is a block diagram illustrating a schematic configuration of a control system in the embodiment.

Next, a schematic configuration of the control system of the inkjet printer 10 in the present embodiment is described on the basis of FIG. 4.

The control system of the inkjet printer 10 is provided with a CPU 58, ROM 59, RAM 60, and an ASIC as an image formation engine control circuit 62, and these devices are mutually connected through a bus 57. The CPU 58 is adapted to perform control on the basis of various control programs stored in the ROM 59. The image formation engine control circuit 62 receives signals from an operation panel 72, external input terminal 73, encoders 65 and 67, pressure sensor 69, and the like to perform an after-mentioned cleaning process at regular intervals on the basis of a program stored in the ROM 59. Also, the image formation engine control circuit 62 performs, on the basis of a control program, on/off control of the choke valve 17 through a valve drive circuit 70, and also drive control of various motors through a motor drive circuit 63. In addition, reference numeral 64 represents a PG motor, 66 a CR motor, 68 an IS motor, and 61 a USB interface (I/F).

Next, the cleaning process performed by the inkjet printer of the present embodiment having the above configuration is described.

Figure 6A:
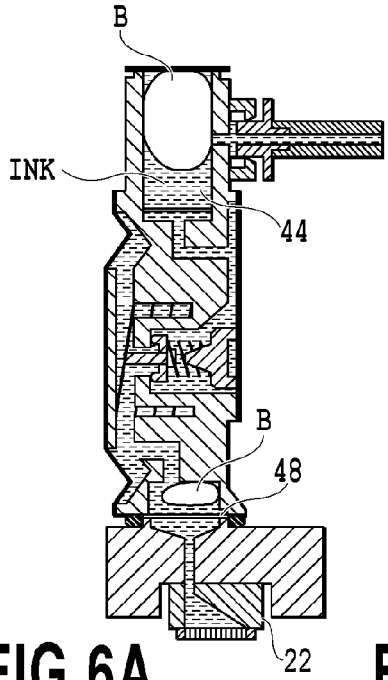
FIGS. 6A to 6E are vertical cross-sectional side views each illustrating an appearance inside the sub-tank at the time of performing the cleaning process in the first embodiment.
Figure 6B:
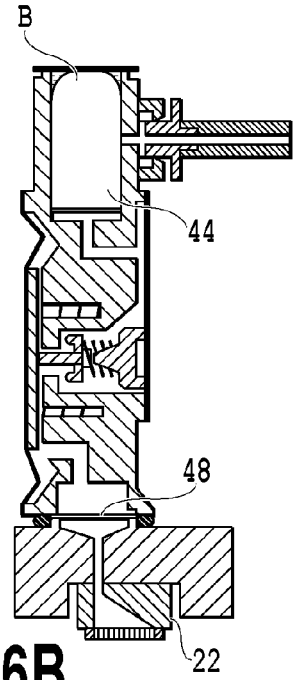
Figure 6C:
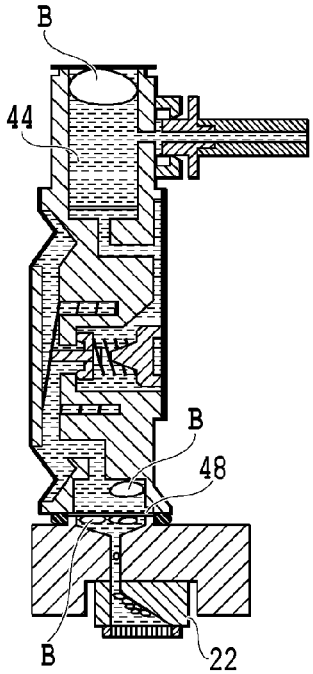
Figure 6D:
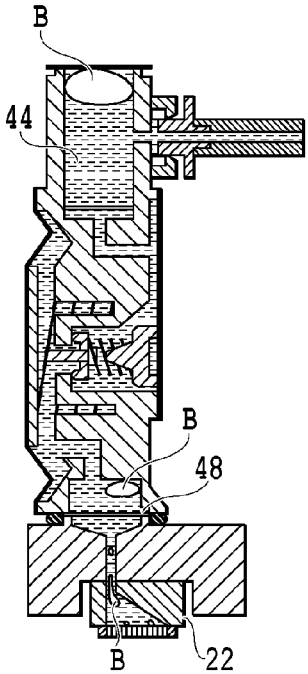
Figure 6E:
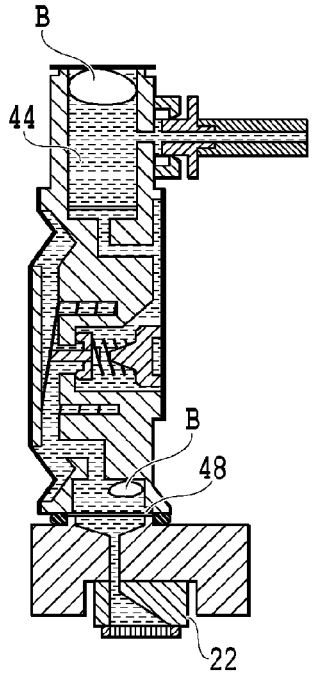
Figure 7:
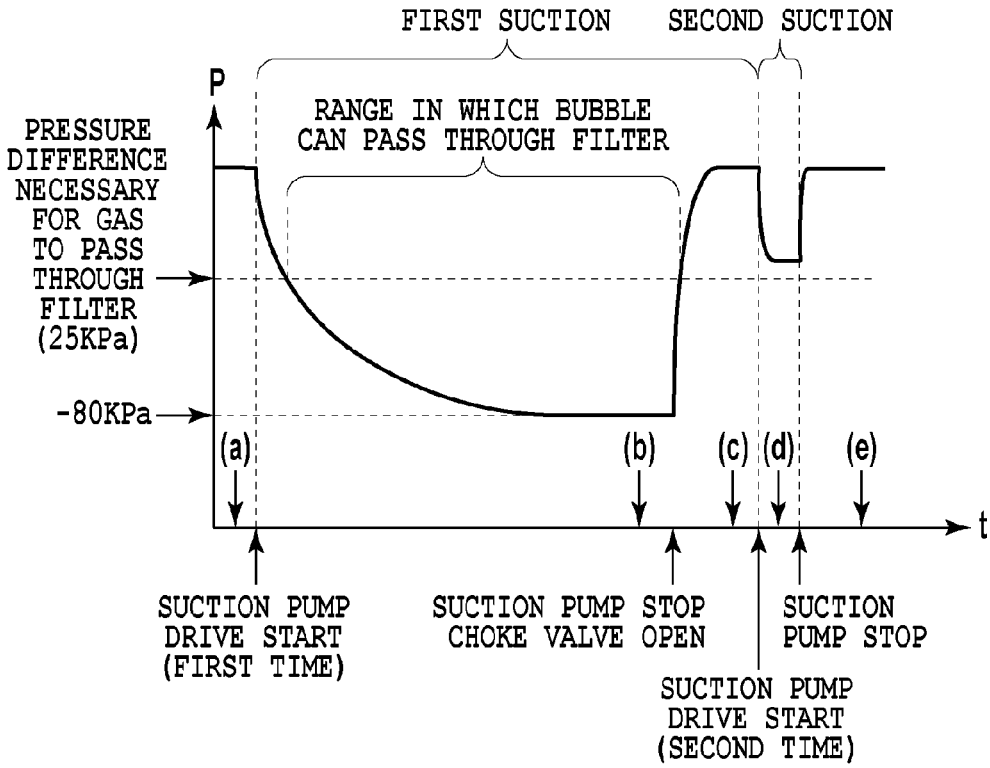
FIG. 7 is a graph illustrating a pressure profile inside a cap for the case of performing a choke cleaning process in the first embodiment.

In the present embodiment, after choke cleaning has been performed as first suction, as second suction, suction operation under negative pressure that prevents a bubble from passing through the filter is performed with compressed supply of the ink being continued. In the following, the cleaning process is more specifically described with reference to a flowchart of FIG. 5, explanatory diagrams of FIGS. 6A to 6E, and graph of FIG. 7. In addition, FIGS. 6A to 6E are diagrams each illustrating a state of bubbles in the printing head 22 for the case where the choke cleaning process is performed, and FIG. 7 is a graph illustrating a pressure profile inside the capping member 24 for the case where the choke cleaning is performed. Symbols (a) to (e) denoted in the graph of FIG. 7 represent a correspondence relationship with the respective stages of FIGS. 6A to 6E.

Figure 5:
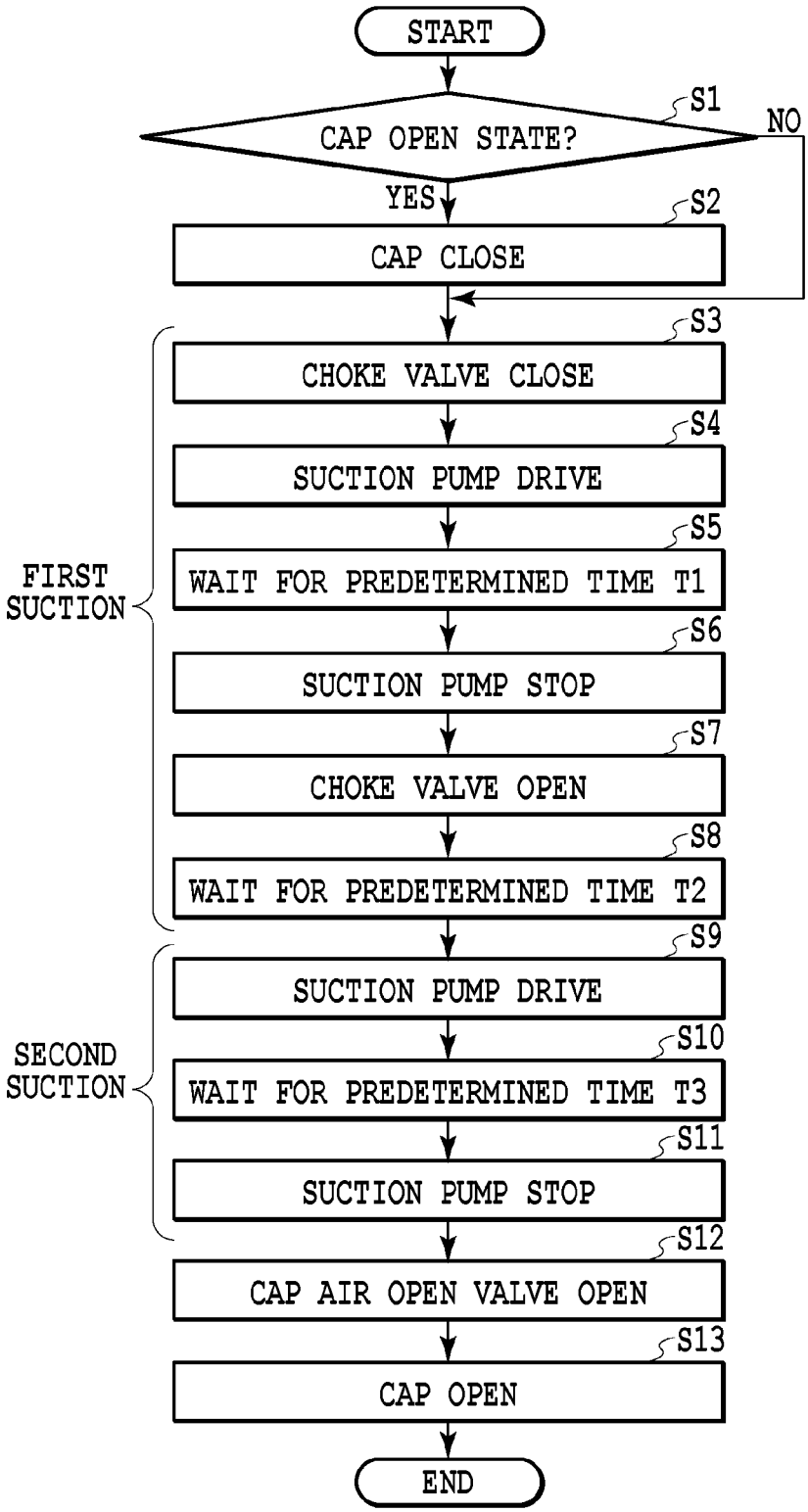
FIG. 5 is a flowchart of a cleaning process in the first embodiment.

In the flowchart of FIG. 5, when a performance instruction for the cleaning process is issued, the CPU 58 provided in the above control system performs processing steps in Steps S1 to S13. Note that an initial state of the sub-tank 23 and printing head 22 is assumed to be a state where bubbles are respectively present in the bubble buffer 44 and at the filter 48 as illustrated in FIG. 6A.

In Step S1, it is determined whether the capping member 24 is in a state of covering the ejection port surface of the printing head 22 (cap close state) or in a state of not covering the ejection port surface (cap open state). Here, in the case of the cap open state, the flow proceeds to Step S2, where cap close operation is performed, and then the flow proceeds to Step S3, whereas in the case of the cap close state, the flow directly proceeds to Step S3. Subsequently, in Steps S3 to S8, the first suction operation that sucks the ink from the nozzle of the printing head 22 is performed. In the first suction operation, first, in Step S3, the valve drive circuit 70 is controlled to close the choke valve 17. This causes a path from the choke valve 17 to the suction pump 25 through the sub-tank 23 and printing head 22 to be sealed.

Then, in Step S4, the motor drive circuit 63 is controlled, and thereby the PG motor 64 is driven to drive the suction pump. This causes depressurization of a space formed between the capping member 24 and the ejection port surface of the printing head 22 to be started. Step S4 corresponds to a stage of "Suction pump drive start" in FIG. 7. This depressurization operation continues for a predetermined time T1 after the start of driving the suction pump (Step S5). By keeping performing the depressurization for the predetermined time T1, a downstream side (suction pump side) of the choke valve 17 is brought into a highly depressurized state to expand under depressurization the bubbles B on an upstream side (ink tank side) of the filter 48, and thereby part of the bubbles B can pass through the filter 48. In the state where the downstream side of the choke valve 17 is sufficiently depressurized, the sub-tank and head are, as illustrated in FIG. 6B, in a state of being almost filled with the bubble. Note that the predetermined time T1 is a time necessary to perform depressurization down to a target pressure (first negative pressure) under an assumed condition. In the present embodiment, the target pressure inside the capping member 24 is set to −80 kPa. Note that a function as a first negative pressure generating unit that applies the above target first negative pressure to the ejection port is achieved by the above choke valve 17, suction pump 25, and capping member 24.

Subsequently, in Step S6, the motor drive circuit 63 is controlled to stop the suction pump, and in Step S7, the valve drive circuit 70 is controlled to open the choke valve 17 and thereby the ink supply toward the downstream side of the choke valve 17 is started. Step S7 corresponds to a stage of "Suction pump stop, Choke valve open" in FIG. 7. When the choke valve 17 is opened to start the ink supply, the depressurized state is rapidly released, and thereby fast ink flow is generated. This fast ink flow causes part of the bubble B remaining on the upstream side of the filter 48 and part of a bubble B on the downstream side of the filter 48 to be discharged from the ejection port of the nozzle of the printing head 22.

For a predetermined time T2 after opening the choke valve 17, the "Suction pump stop, Choke valve open" state is kept (Step S8). This is to wait for a pressure inside the capping member 24 to return to a pressure enough to prevent the bubbles B from passing through the filter. Accordingly, the predetermined time T2 is set to a time enough to return, after opening the choke valve 17, to the pressure enough to prevent the bubbles B from passing through the filter 48. A state in Step S8 where the bubbles B remain in the sub-tank 23 and printing head 22 at the time after the predetermined time T2 has passed is, as illustrated in FIG. 6C, a state where bubbles remain to a certain extent in the flow path inside the printing head 22. The steps described hitherto are defined as the first suction operation (first cleaning operation).

Subsequently, the second suction is started. The second suction operation is performed in a state where the choke valve 17 is opened and the ink is continuously supplied. First, in Step S9, by controlling the motor drive circuit 63 to drive the PG motor 64, driving of the suction pump 25 is started. Step S9 corresponds to a stage of second "Suction pump drive start" in FIG. 7. The driving of the suction pump 25 is performed continuously for a predetermined time T3 (Step S10). This suction operation is performed with the pressure inside the capping member 24 being set to a negative pressure (second negative pressure) of which an absolute value is smaller than that of the first negative pressure so as to prevent the bubbles B from passing through the filter 48. In the present embodiment, the suction operation is performed with, for example, a negative pressure of approximately −20 kPa being applied to the ejection port with the suction pump 25. As a result, only the bubble that was, in the stage of FIG. 6C, present on the downstream side of the filter 46 moves as illustrated in FIG. 6D, and then discharged from the ejection port of the nozzle of the printing head 22. Note that the predetermined time T3 is set to a time for the bubble on the downstream side of the filter 48, which causes improper ejection, to be completely discharged from inside the printing head 22. After that, in Step S11, the motor drive circuit 63 is controlled to stop the PG motor 64, and the driving of the suction pump 25 is stopped to terminate the second suction operation (second cleaning operation, third process). Note that, in the present embodiment, a function as a second negative pressure generating unit that generates the second negative pressure to apply it to the ejection port is achieved by the suction pump 25 and capping member 24.

After the second cleaning operation, in Step S12, the valve drive circuit 70 is driven to open the air open valve 15 that is communicatively connected to the capping member 24, and further, in Step S13, the cap open state is achieved to achieve a stand-by state. Thus, the series of cleaning processing steps are terminated. At this time, as illustrated in FIG. 6E, the bubbles inside the sub-tank 23 are reduced as compared with the initial state, and the bubble inside the flow path of the printing head 22 is brought into a discharged state.

As described above, in the present embodiment, the first suction operation causes the bubble present on the upstream side of the filter 48 to move toward the downstream side of the filter 48, and the second suction operation causes only the bubble present on the downstream side of the filter 48 to be discharged from the ejection port of the nozzle of the printing head. This enables a bubble, which causes improper ejection, to be discharged and enables the ejection state of the printing head to be kept in good state with small ink consumption to reduce running cost.

Also, the present embodiment is adapted to, after the first suction operation, without achieving the cap open state, directly perform the second suction operation. As described, if after the first suction operation, the second suction operation is performed without taking much time, a bubble inside the flow path of the printing head can be discharged before the bubble moves up and away from the ejection port of the nozzle. This enables not only a required time for the cleaning process to be reduced but also a waste ink amount to be suppressed to a requisite minimum amount.

Second Embodiment

Next, a second embodiment of the present invention is described.

Figure 8:
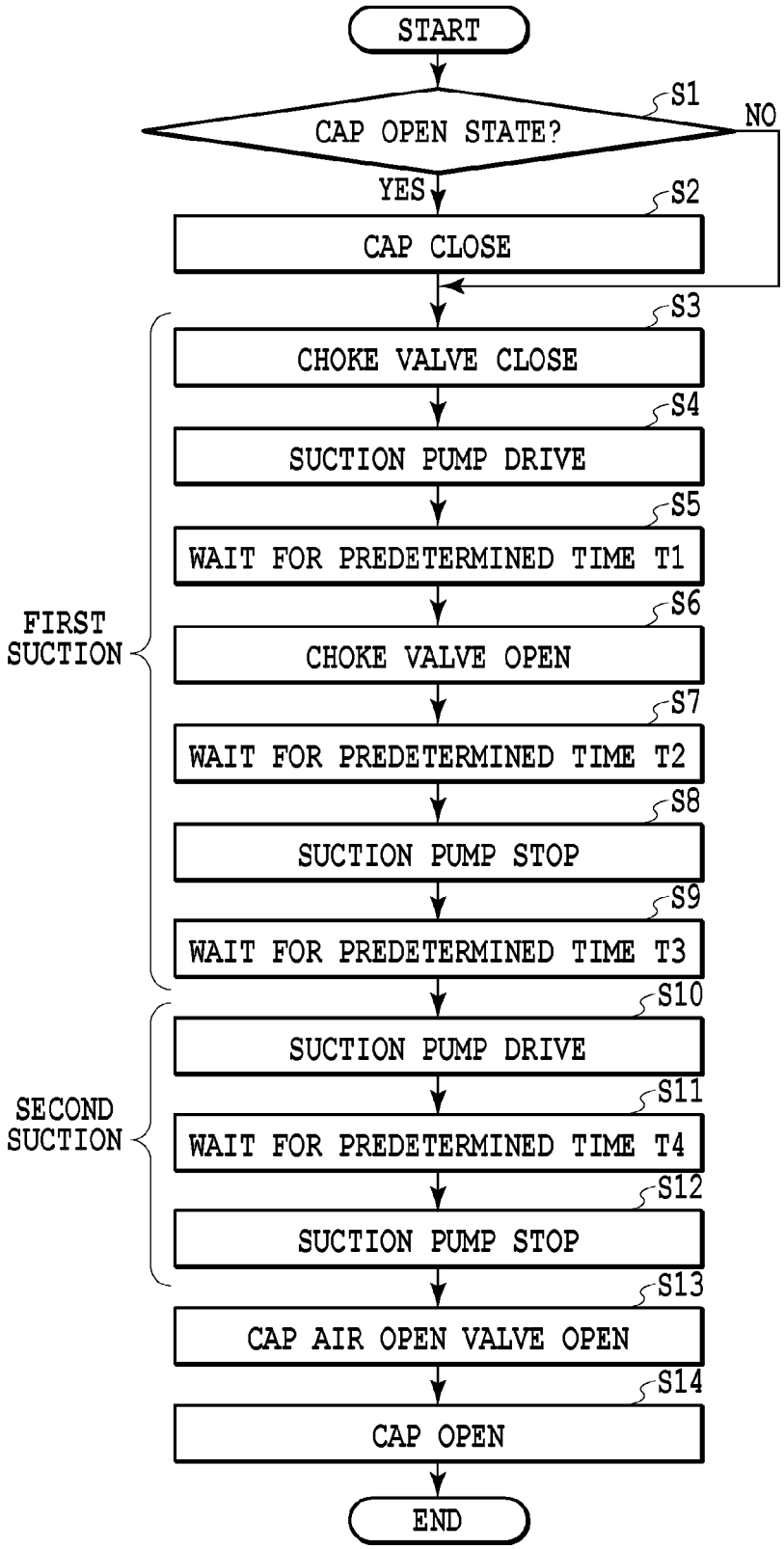
FIG. 8 is a flowchart of a cleaning process in a second embodiment.

The above-described first embodiment is configured to, in the first suction operation, stop the suction pump 25 and then open the choke valve 17; however, the second embodiment is configured to open the choke valve 17 and then stop the suction valve 25. Note that the rest of the configuration is the same as that of the above-described first embodiment, and therefore the description is provided here on the basis of a flowchart in FIG. 8 with focusing on different points from the first embodiment.

In the second embodiment, in the same manner as in the first embodiment, the first suction operation is started. In the first suction operation, in Step S3, the choke valve 17 is closed, and in Step S4, the suction pump 25 is driven to start depressurization. Then, as indicated in Step S5, the depressurization operation is continuously performed for the predetermined time T1.

Subsequently, in Step S6, the choke valve 17 is opened to start ink supply. This causes the depressurized state to be reduced and released. However, even at this time, the suction pump 25 is continuously driven, which is a different point from the first embodiment. As described, by driving the suction pump with opening the choke valve 17, as compared with the case of not driving the suction pump 25 with opening the choke valve 17, faster flow can be generated in the head flow path. For this reason, more bubbles attached on the upstream side of the filter 48 can be more strongly moved toward the downstream side of the filter 48, and therefore a bubble removing effect is improved. Note that the predetermined time T2 is a time necessary to instantaneously generate the faster flow, and therefore can be an arbitrary short time.

Subsequently, in Step S8, the operation of the suction pump 25 is stopped, and a state of "Suction pump stop, Choke valve open" is kept for the predetermined time T3 (Step S8). This is to wait for the pressure inside the capping member 24 to return to a pressure enough to prevent the bubbles B from passing through the filter. The predetermined time T3 is set to a time enough to return, after opening the choke valve 17, to the pressure enough to prevent the bubbles B from passing through the filter 48. Thus, the first suction operation is terminated.

Subsequently, the second suction operation is started. Processing steps of and after the second suction operation are performed in the same manner as in the above-described first embodiment. This enables, even in the second embodiment, only a bubble that was moved toward the downstream side of the filter 48 by the first suction operation to be discharged from the ejection port of the nozzle of the printing head, and the bubble that causes improper ejection to be discharged with small ink consumption.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-194745, filed Aug. 31, 2010 which is hereby incorporated by reference herein in its entirety.

What is claimed is:

1. An inkjet printer that supplies ink in an ink tank to a printing head through a flow path and a filter provided in the flow path, and ejects the ink from an ejection port of the printing head to perform printing, the inkjet printer comprising:

an on/off valve that is provided in flow path closer to the ink tank than the filter is to the ink tank;

a negative pressure generating unit for generating a negative pressure to be applied to the ejection port; and a control unit that controls operation of the on/off valve and operation of the negative pressure generating unit, wherein the negative pressure generating unit can apply, to the ejection port, a first negative pressure that enables a bubble to pass through the filter, and a second negative pressure that has a smaller absolute value than the first negative pressure and is at a level such that it is difficult for the bubble to pass through the filter, and the control unit controls the negative pressure generating unit to apply the first negative pressure to the ejection port with closing the on/off valve, and then, after opening the on/off valve, controls the negative pressure generating unit to apply the second negative pressure to the ejection port.

2. The inkjet printer according to claim 1, wherein the control unit controls the negative pressure generating unit to apply the first negative pressure to the ejection port with closing the on/off valve, and then, after opening the on/off valve, to apply the second negative pressure to the ejection port with opening the on/off valve.

3. The inkjet printer according to claim 1, wherein the control unit controls the negative pressure generating unit to apply the first negative pressure to the ejection port with closing the on/off valve, and then, after opening the on/off valve and a negative pressure to be applied to the ejection port has become a negative pressure that is at a level such that it is difficult for the bubble to pass through the filter, controls the negative pressure generating unit to apply the second negative pressure to the ejection port.

4. The inkjet printer according to claim 1, wherein the control unit controls the negative pressure generating unit to apply the first negative pressure to the ejection port with closing the on/off valve, and then, before opening the on/off valve, stops the negative pressure generating unit.

5. The inkjet printer according to claim 1, wherein the control unit controls the negative pressure generating unit to apply the first negative pressure to the ejection port with closing the on/off valve, and then, even after opening the on/off valve, for a predetermined time, controls the negative pressure generating unit to apply a negative pressure to the ejection port.

6. An inkjet printer that can supply ink in an ink tank to a printing head through a flow path and a filter provided in the flow path, and eject the ink from an ejection port of the printing head to perform printing, and also can externally apply a negative pressure to the ejection port of the printing head to thereby discharge a bubble present at and inside the printing head from the ejection port of the printing head together with the ink, the inkjet printer comprising:

an on/off valve that is provided in the flow path;

a negative pressure generating unit that generates a negative pressure to be applied to the ejection port of the printing head; and a control unit that controls the negative pressure generating unit, wherein the control unit performs a first cleaning operation that controls the negative pressure generating unit to apply a first negative pressure, which enables a bubble to pass through the filter, to the ejection port with closing the on/off valve, and then opens the on/off valve, and a second cleaning operation that controls the negative pressure generating unit to apply to the ejection port a second negative pressure at a level that makes it difficult for a bubble to pass through the filter.

7. A bubble reducing method for an inkjet printer that supplies ink in an ink tank to a printing head through a flow path and a filter provided in the flow path, and ejects the ink from an ejection port of the printing head to perform printing, the bubble reducing method comprising the steps of:

with closing an on/off valve provided between the ink tank and the filter, applying a first negative pressure that enables a bubble to pass through the filter; and after opening the on/off valve, applying, to the ejection port, a second negative pressure that has a smaller absolute value than the first negative pressure and is at a level such that it is difficult for the bubble to pass through the filter.

8. An ink jet printer comprising:

a print head comprising an ejection port for ejecting ink and an ink retaining portion for retaining ink to be ejected from the ejection port, an ink tank that contains ink to be supplied to the print head;

a filter provided between the ink retaining portion and the ejection port;

an on/off valve that controls a flow of ink between the ink tank and the ink retaining portion;

a pump that sucks ink and air through the ejection port; and a control unit that controls the on/off valve and the pump, wherein the control unit performs a first recovery control in which the pump is driven in a condition where the on/off valve is closed to apply, to the ink retaining portion and the inside of the ejection port, a pressure equal to or more than a predetermined pressure that enables a bubble to pass through the filter and then the on/off valve is opened, and a second recovery control in which the pump is driven in a condition where the valve is opened, the pressure in the ink retaining portion and the ejection port being lower than the predetermined pressure when the second recovery control is performed.

9. The ink jet printer according to claim 8, wherein the control unit sequentially performs the first recovery control and the second recovery control.

10. The ink jet printer according to claim 8, wherein the pump is connected to a capping member, and a first recovery operation and a second recovery operation are performed in the condition where the ejection port of the print head is covered by the capping member.

11. The ink jet printer according claim 8, wherein the predetermined pressure is a minimum pressure required for breaking a meniscus as a boundary between liquid and air in the filter.

* * * * *